US007497259B2

(12) United States Patent
Leising et al.

(10) Patent No.: US 7,497,259 B2
(45) Date of Patent: Mar. 3, 2009

(54) SYSTEM AND METHOD FOR FORMING CAVITIES IN A WELL

(75) Inventors: Lawrence J. Leising, Missouri City, TX (US); Robert Michael Ramsey, Missouri City, TX (US); Howard L. McGill, Lufkin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 46 days.

(21) Appl. No.: 11/610,914

(22) Filed: Dec. 14, 2006

(65) Prior Publication Data

US 2007/0175637 A1 Aug. 2, 2007

Related U.S. Application Data

(60) Provisional application No. 60/764,197, filed on Feb. 1, 2006.

(51) Int. Cl.

| | |
|---|---|
| ***E21B 43/112*** | (2006.01) |
| ***E21B 43/114*** | (2006.01) |
| ***E21B 43/116*** | (2006.01) |
| ***E21B 43/119*** | (2006.01) |

(52) U.S. Cl. ..... 166/297; 166/255.2; 166/55

(58) Field of Classification Search ..... 166/255.2, 166/297, 55

See application file for complete search history.

(56) References Cited

U.S. PATENT DOCUMENTS

| | | | | |
|---|---|---|---|---|
| 4,346,761 | A * | 8/1982 | Skinner et al. | 166/206 |
| 4,554,975 | A * | 11/1985 | Vann et al. | 166/297 |
| 5,335,724 | A | 8/1994 | Venditto | |
| 2006/0278393 | A1 * | 12/2006 | Hunt et al. | 166/298 |

OTHER PUBLICATIONS

SPE 96732-Packerless Multistage Fracture-Stimulation Method Using CT Perforating and Annular Path Pumping By L. East, J. Rosato, M. Farabee and B.W. McDaniel, Halliburton.

* cited by examiner

*Primary Examiner*—David J Bagnell
*Assistant Examiner*—Brad Harcourt
(74) *Attorney, Agent, or Firm*—Rodney Warfford; David Cate; Robin Nava

(57) ABSTRACT

A technique is provided to form perforations in a wellbore. The formation of perforations is carefully controlled by a perforating device to create a series of sequential perforations in a desired arrangement. The perforating device is lowered to a desired location in the wellbore and then moved incrementally to enable sequential perforations in the desired arrangement.

17 Claims, 4 Drawing Sheets

SYSTEM AND METHOD FOR FORMING CAVITIES IN A WELL

CROSS-REFERENCE TO RELATED APPLICATION

The present document is based on and claims priority to U.S. provisional application Ser. No. 60/764,197, filed Feb. 1, 2006.

BACKGROUND

A variety of perforating and other fracturing techniques are conducted in wellbores drilled in geological formations. The resulting perforations and/or fractures facilitate the flow of desired fluids through the formation. For example, the production potential of an oil or gas well can be increased by improving the flowing ability of hydrocarbon based fluids through the formation and into the wellbore. In some applications, however, difficulties arise in initiating and achieving desirable fractures to facilitate fluid flow.

In horizontal wells, for example, it is common to use a slotted or pre-perforated liner. This type of liner causes difficulty in using a slurry within the annulus to fracture the formation. The difficulty arises because the pressure drop of the annular flow causes the pressure to be higher at the heel of the horizontal wellbore then at the toe of the horizontal wellbore. Attempts have been made to cut slots or cavities into the formation around the wellbore to facilitate fracture by acting as a fracture initiation site. However, such attempts have suffered from an inability to adequately control and accomplish the desired cutting into the formation.

SUMMARY

In general, the present invention provides a system and method for forming perforations/cavities in a wellbore. The formation of perforations is carefully controlled to create a series of sequential perforations in a desired arrangement. A perforating device is lowered into a wellbore by a perforating string and positioned at a desired wellbore location. The perforating device is then moved accurately and incrementally to enable sequential perforations in the desired arrangement.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for forming perforations that can be used to improve the flow of fluids through subterranean formations. The system and methodology enable the perforation of a surrounding formation in a more selective and controlled manner that enables a better preparation of the formation. Generally, a perforating string is moved into a wellbore, and a perforating device is used to create incremental perforations in the surrounding formation.

Figure 1:
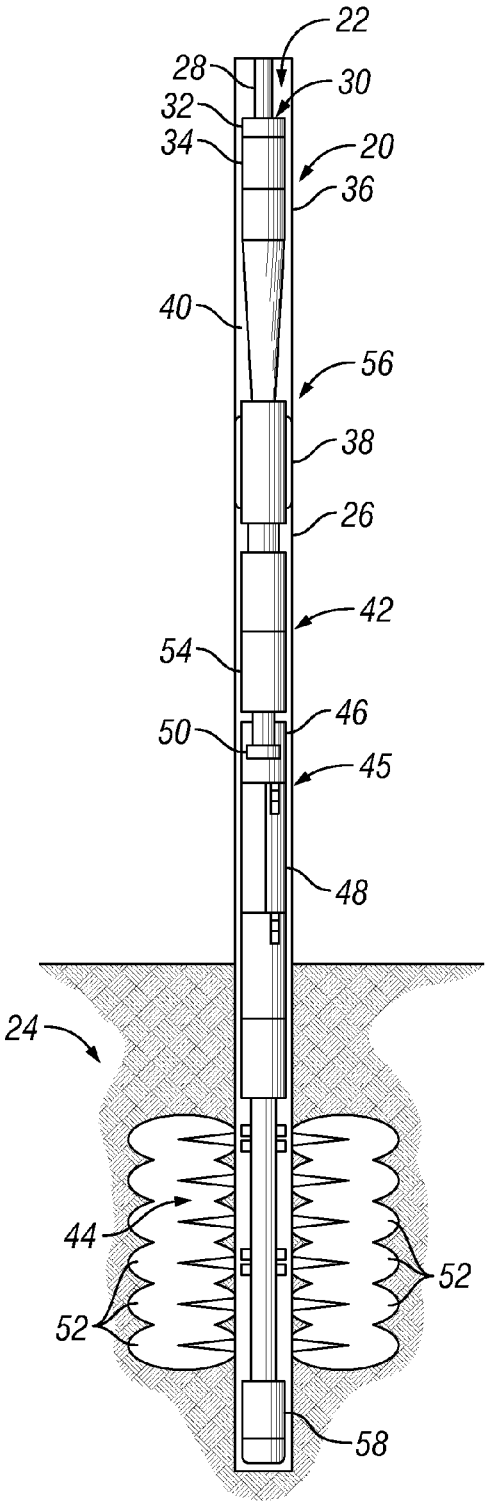
FIG. 1 is an elevation view of a perforating string deployed in a wellbore, according to an embodiment of the present invention.

Referring generally to FIG. 1, a perforating string 20 is illustrated as deployed in a wellbore 22 that extends into a desired formation 24. In many applications, wellbore 22 is lined with an appropriate liner or well casing 26. A conveyance system 28, such as coiled tubing, is used to move perforating string equipment 30 downhole. Depending on the specific well application, the components, the number of components, and the arrangement of components in perforating string equipment 30 may vary.

In the embodiment illustrated, deployment system 28 is coupled to a coiled tubing connector 32 used to connect the coiled tubing to a variety of other components. For example, perforating string 20 may comprise a check valve section 34, such as a dual flapper check valve section, coupled with a drop ball disconnect section 36. Drop ball disconnect section 36, in turn, may be coupled to an anchoring mechanism 38 by a dual circulation sub 40. The perforating string equipment 30 may further comprise a multi-cycle incrementing tool 42 coupled to a perforating device 44 through, for example, an orientation device 45 having a swivel 46 that may be eccentrically waited via an eccentric weight portion 48. The eccentric weight portion 48 is used to orient perforating device 44 particularly when the perforating device 44 and eccentric weight portion 48 are moved into a deviated, e.g. horizontal, wellbore. By way of example, the eccentrically weighted portion 48 is pulled downwardly, thus rotating perforating device 44 via swivel 46 to a specific, desired orientation. The eccentrically weighted portion 48 may be formed in a variety of ways, including an attached eccentric mass or an offset hole or axis to provide the eccentricity.

Other components also may comprise a variety of shapes, sizes and configurations. For example swivel 46 may comprise a ball bearing or a roller bearing to enable a smooth, dependable swivel capability. Additionally, some embodiments of swivel 46 and the overall orientation device 45 may be designed with a minimum pump open area to enable slow pumping of fluid while reciprocating multi-cycle incrementing tool 42. By enabling slower pumping of fluid for incrementing tool 42, mechanical friction is reduced. Other embodiments of orientation device 45 may comprise additional features, such as a locking device 50 designed to selectively lock swivel 46 at a desired orientation during certain procedures, e.g. during perforation of the surrounding formation.

The anchoring mechanism 38 also may comprise a variety of sizes, shapes and configurations. Anchoring mechanism 38 is used to restrict the movement of conveyance system 28. For example, if conveyance system 28 is formed of coiled tubing, anchoring mechanism 38 restricts the movement of the coiled tubing 28 during perforation operations, such as during the onset of pumping and during the jetting process when perforation device 44 is constructed as part of an abrasive jetting bottom hole assembly. Anchoring mechanism 38 prevents the movement of coiled tubing 28 while the various downhole operations are performed. A variety of techniques can be utilized to actuate anchoring mechanism 38. For example, anchoring mechanism 38 can be set via compression; the anchoring mechanism can be expanded through use of a tubing anchor; the anchoring mechanism can be set by flowing fluid therethrough at a high rate; the anchoring mechanism can be set by a tensile pull; or the anchoring mechanism can be set through other appropriate techniques. Alternatively, anchoring mechanism 38 can be selectively actuated by an appropriate actuator responsive to an electric signal, an optical signal, a hydraulic signal, and/or other appropriate signal sent downhole. The anchoring mechanism 38 also may comprise other features, such as a positive lockout to prevent the anchor from setting until internal pressure rises above a threshold value.

Similarly, the multi-cycle incrementing tool 42 can be constructed in a variety of sizes, shapes and configurations, as discussed in greater detail below. The incrementing tool 42 enables precise control over placement of perforations/cavities 52 in formation 24. Additionally, the incrementing tool 42 is not susceptible to deployment system stick-slip, enables a more efficient cutting technique, and facilitates modification of the jetting time when perforating device 44 utilizes jetting nozzles to form cavities 52. The multi-cycle incrementing tool 42 can be used with a variety of perforating mechanisms, including oriented, abrasive jetting mechanisms and shaped charge mechanisms. Also, incrementing tool 42 enables accurate placement of the perforating device 44 over existing cavities 52 to, for example, form deeper cavities. In one example, the cavities 52 can be re-jetted with abrasive, acid or nitrogen to deepen the cavities and/or to increase permeability of the formation. In another example, the cavities can be re-jetted with materials, e.g. fiber or consolidating agent, to consolidate a sand/gravel pack and to prevent flowback of formation fines or cavity collapse. The multi-cycle incrementing tool 42 also may comprise a variety of other features, such as a tattletale 54 in the form of a circulation port that opens to the surrounding annulus when incrementing tool 42 is incremented to a fully extended position. At this fully extended position, the circulation port 54 opens to the annulus to provide a pressure indication during pumping that incrementing tool 42 has reached its fully extended position.

In the embodiment illustrated, anchoring mechanism 38, multi-cycle incrementing tool 42, swivel/orienting device 46, and perforation device 44 are combined to form one embodiment of a bottom hole assembly 56. However, other components can be added to bottom hole assembly 56 or utilized in conjunction with bottom hole assembly 56. For example, the perforating string 20 may comprise an optional reversing valve 58. The optional reversing valve 58 can be utilized as a check valve that enables the pressurization of fluid within coiled tubing 28 and perforating string 20 to enable desired operations, including the pumping of abrasive jetting fluid for formation of cavities 52. However, the reversing valve 58 also allows the reversing of fluid flow up through perforating string 20 and coiled tubing 28 to, for example, clean out accumulated sand.

Figure 2:
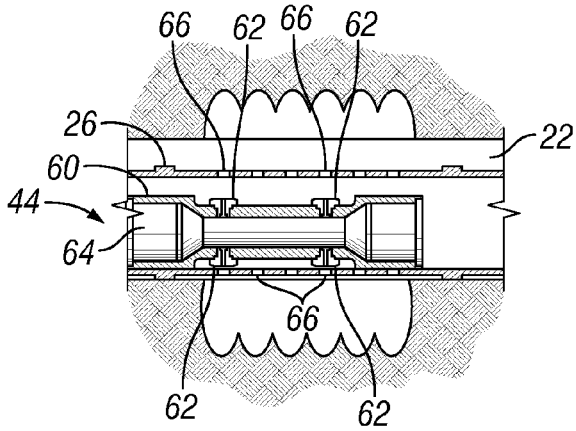
FIG. 2 is a cross-sectional view of a perforating device positioned in a deviated wellbore, according to an embodiment of the present invention.

Referring generally to FIG. 2, one embodiment of perforating device 44 is illustrated as deployed in wellbore 22 at a deviated, e.g. horizontal, section of the wellbore. In this embodiment, perforating device 44 has been oriented to a desired perforation angle by eccentric weight 48 of orientation device 45. As illustrated, perforation device 44 comprises a generally tubular body section 60 to which is mounted perforation features 62 for forming the perforation/cavities 52 in the surrounding formation 24. Perforation features 62 may comprise shaped charges or jetting nozzles. In the embodiment illustrated, perforation features 62 are illustrated as jetting nozzles exposed to a hollow interior 64 of body section 60. Abrasive jetting fluid can be pumped down through coiled tubing 28 and through perforating string 20 into hollow interior 64. The jetting fluid is sufficiently pressurized to deliver a high-pressure jet oriented in a generally radially outward direction. The high-pressure jet pierces liner 26 as indicated by openings 66 and cuts into the surrounding formation to form cavities 52.

The precise control over the positioning of perforation device 44 and perforation features 62 afforded by multi-cycle incrementing tool 42 enables the formation of perforations 52 in specific and desired patterns. For example, the incremental movements of perforating device 44 can be selected to create a series of linked perforations, as further illustrated in FIG. 3. The linked perforations or cavities 52 form a continuous cut in formation 24. The continuous cut can be used, for example, as a fracture initiation site that facilitates control over the fracturing of formation 24. In some applications, for example, production can be optimized by using the continuous cut, created by the linked cavities, to initiate fractures selectively starting at the toe of a horizontal well and working towards the heel of the well.

Figure 3:
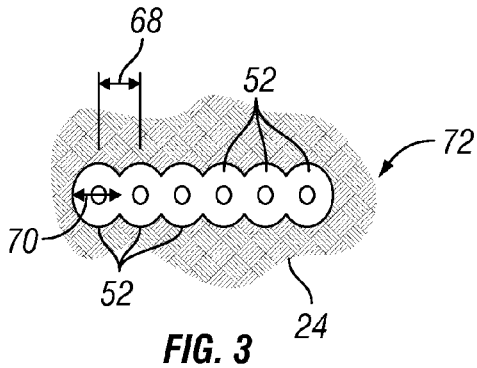
FIG. 3 is an illustration of cavities formed in a formation by the perforating device, according to an embodiment of the present invention.

Multi-cycle incrementing tool 42 is used to control the specific distance moved by a perforating device 44 between each set of cavities formed. For example, once perforating device 44 is anchored at a desired wellbore location, a first set of cavities 52 may be formed. Incrementing tool 42 is then cycled which moves the perforating device 44 an incremental distance 68, as illustrated in FIG. 3. Another set of cavities 52 is then formed followed by movement of perforating device 44 over an incremental distance, e.g. incremental distance 68. This process may be repeated until multi-cycle incrementing tool 42 has been cycled through its full extension or contraction. In the embodiment illustrated in FIGS. 2 and 3, perforating device 44 comprises two pairs of jetting nozzles 62 oriented in generally opposite directions, and multi-cycle incrementing tool 42 is designed for movement through three increments before returning to its original position. Accordingly, each pair of jetting nozzles 62 forms a series of six linked cavities 52. By selecting an incremental distance 68 substantially similar to a cavity diameter 70, a continuous cut 72 can be formed in formation 24. By way of example, incremental distance 68 may be 50-100% of the cavity diameter 70.

Figure 4:
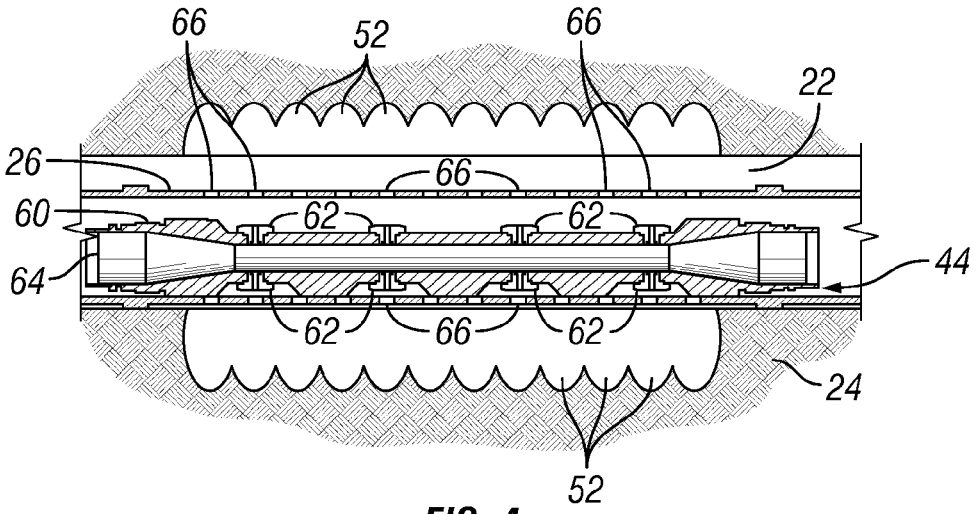
FIG. 4 is an alternate embodiment of a perforating device, according to another embodiment of the present invention.
Figure 5:
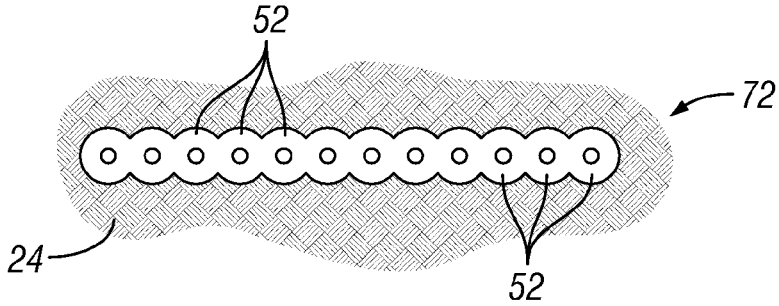
FIG. 5 is an illustration of cavities formed in a formation by the alternate perforating device, according to an embodiment of the present invention.

Perforating device 44, however, can have a variety of configurations to form cavities 52 and cuts 72 in a variety of shapes, sizes and/or forms. One alternate embodiment is illustrated in FIG. 4. In this embodiment, two sets of four perforation features 62, e.g. jetting nozzles or shaped charges, are positioned along the body section 60. Accordingly, with three incremental movements of perforating device 44 via incrementing tool 42 twelve cavities 52 are created to form a longer continuous cut 72, as illustrated in FIG. 5. Additionally, other numbers and arrangements of perforating feature 62 can be used to create other patterns of cavities 52. Multi-cycle incrementing tool 42 can be constructed to have different numbers of increments and/or increments of other distances, depending on the specific application for which it is designed.

The precise control over positioning of perforating device 44 and perforating features 62 enables repeated perforating, if desired, to form deeper cavities 52. For example, if perforation features 62 comprise jetting nozzles, each cavity 52 can be re-jetted by cycling multi-cycle incrementing tool 42 through the same series of incremental cycles and again directing high-pressure jetting fluid through hollow interior 64. The perforating device 44 also can be cycled around again to circulate acid, nitrogen or other injection fluids to help condition the surrounding formation.

Figure 6:
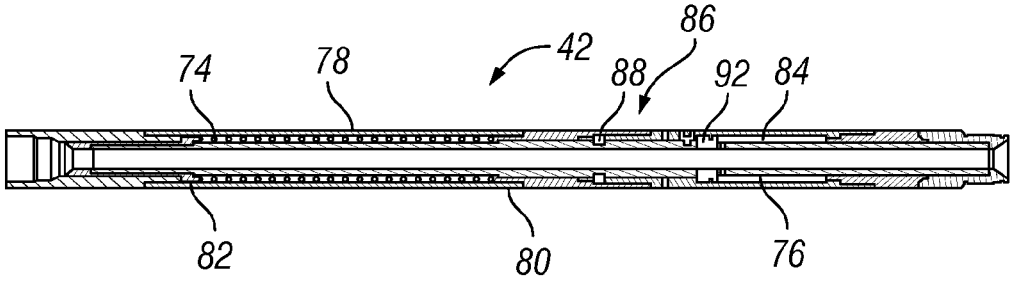
FIG. 6 is a cross sectional view of a multi-cycle incrementing tool, according to an embodiment of the present invention.

Incremental movement of perforating device 44 is controlled by incrementing tool 42 which can be constructed in a variety of the embodiments, depending on various well operation parameters, such as type of force input used to cycle the incrementing tool, the type of perforating feature utilized, the well environment, the cavity formation pattern, and other parameters. In one embodiment, the pressure of the jetting fluid pumped downhole and through jetting nozzles 62 is used to cycle incrementing tool 42. As illustrated in FIG. 6, this type of multi-cycle incrementing tool uses a spring biased unbalanced slip joint with incrementing J-slot to lengthen the tool every time the jetting fluid pumps are shut down. The incrementing tool 42 is designed for a specific number of increments before returning to its original position. Thus, the tool can be repeatedly cycled between contracted and extended positions.

As illustrated in FIG. 6, this example of multi-cycle incrementing tool 42 comprises an outer housing 74 and an inner extension member 76 slidably mounted within outer housing 74. A biasing spring 78 is trapped between a housing stop 80 of outer housing 74 and an abutment 82 of inner extension member 76 to biased extension member 76 in a first longitudinal direction with respect to outer housing 74. The incrementing tool 42 also may comprise a partially compensating bias area 84 fed by internal pressure. The compensating bias area 84 serves to reduce the size required for biasing spring 78. Additionally, inner extension member 76 and outer housing 74 are coupled through a J-slot mechanism 86 having a J-pin 88 that is moved along a J-slot pattern 90 (see FIG. 7). In this embodiment, internal pressurization due to, for example, actuating the jetting fluid pumps causes relative movement of inner extension member 76 with respect to outer housing 74. Release of that pressure to less than the bias pressure allows biasing spring 78 and compensating bias area 84 to cause relative movement of inner extension member 76 and outer housing 74 to advance the incrementing tool toward the next incremental position. Additionally, an anti-rotation pin 92 can be used to secure the J-slot mechanism with respect to outer housing 74.

Figure 7:
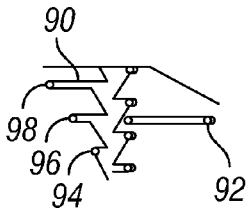
FIG. 7 is a schematic view of a J-slot mechanism, according to an embodiment of the present invention.

Different styles of J-slot mechanisms can be used depending on, for example, the size and number of desired increments. As illustrated in FIG. 7, one embodiment comprises a continuous J-slot having three incremental positions 94, 96 and 98. Regardless of where the J-slot mechanism 86 is initially positioned, pressuring up causes incrementing tool 42 to move to one of the incremental positions 94, 96 or 98. Upon release of that pressure, biasing spring 78 and bias area 84 cause the J-slot mechanism 86 to shift toward the next incremental position. By releasing pressure, e.g. shutting down the jetting fluid pumps, two times, the J-slot mechanism 86 is shifted through all three incremental positions. The incremental movement enables the accurate positioning and creation of cavities 52. Furthermore, this design is able to capitalize on the "weep hole" effect by providing a path for the jet to travel rather than just stagnating in one cavity. This effect helps increase the penetration of the jet used to create cavities 52.

Figure 8:
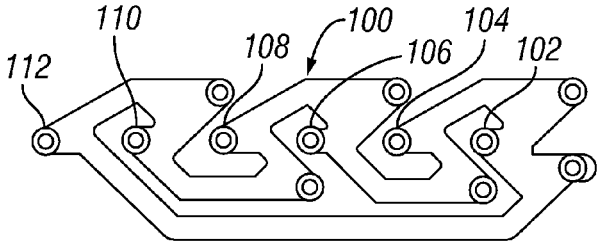
FIG. 8 is a schematic view of an alternate J-slot mechanism, according to another embodiment of the present invention.
Figure 9:
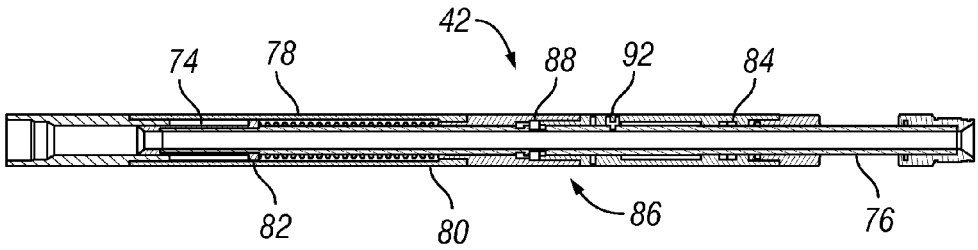
FIG. 9 is a cross sectional view of the multi-cycle incrementing tool illustrated in FIG. 6 but shown in an extended position, according to an embodiment of the present invention.

For other applications, alternate J-slot mechanisms 86 can be used. As illustrated in FIG. 8, for example, a J-slot pattern 100 can be used that provides a different number of incremental positions. In this embodiment, the J-slot pattern 100 provides six incremental positions 102, 104, 106, 108, 110 and 112. Regardless of the specific type of pattern, incrementing tool 42 can be cycled through multiple increments between a contracted position, as illustrated in FIG. 6, and a fully extended position, as illustrated in FIG. 9.

In operation, the perforating string 20 is run in hole to place perforating device 44 at a desired location within wellbore 22. Orienting device 45 can automatically orient perforating device 44 at a desired angular position within, for example, a deviated wellbore. Anchoring mechanism 38 is then set. An initial cavity or set of cavities 52 is created in formation 24 by, for example, abrasive jetting. Multi-cycle incrementing tool 42 is then incremented to the next sequential position and the next cavity or set of cavities is created. This process can be repeated until multi-cycle incrementing tool moves along its entire stroke. The entire perforation pattern or a portion of it can then be repeated, if necessary, to enlarge the cavities or otherwise condition the formation. If perforating device 44 comprises an abrasive jetting device and incrementing tool 42 is cycled by releasing pressure, the incremental movements between creating cavities can be achieved by shutting down the abrasive jetting fluid pumps for each incremental movement.

Figure 10:
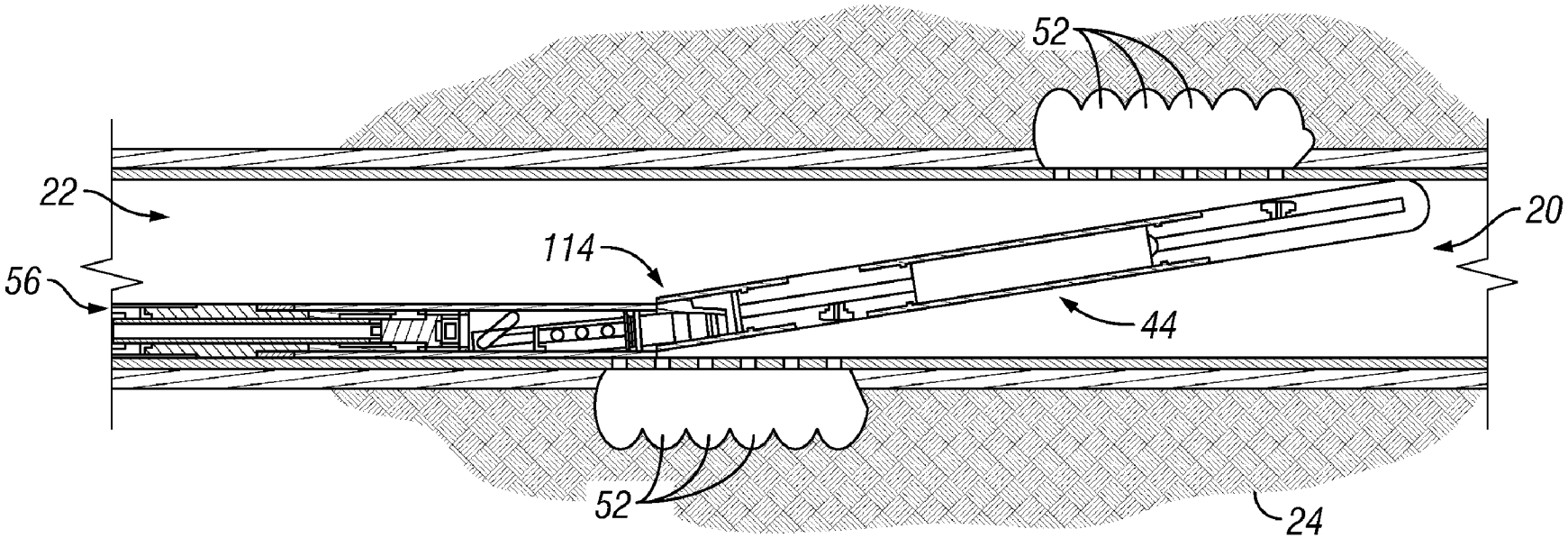
FIG. 10 is a front elevation view of an alternate embodiment of a perforating string, according to an embodiment of the present invention.

Depending on the well environment and the specific application, alternate or additional components can be utilized in bottom hole assembly 56 or the overall perforating string 20. For example, the bottom hole assembly 56 may comprise an elbow joint 114 that is selectively placed at an angle to position an extension arm at an angle with respect to wellbore 22, as illustrated in FIG. 10. This action places the perforating device 44 in close proximity to the wellbore wall. The arrangement allows, for example, a small diameter tool to pass through restrictions in the tubing string and then "open up" to jet in the much larger diameter casing. The jets can thus be optimally positioned with respect to the casing inside diameter. By way of example, elbow joint 114 may be spring-loaded to bias the perforating string and bottom hole assembly 56 to a generally straight position during running in hole and to a bent position, as illustrated, when under pressure while jetting. The elbow joint 114 may be designed such that jetting forces do not straighten the joint. Additionally, the jetting nozzles may be arranged so they are oriented generally perpendicular to or at a slight angle with respect to the wellbore axis.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for making cavities in a wellbore, comprising:

a perforating string sized for deployment in a wellbore, the perforating string comprising:

a perforating device;

an anchoring mechanism to anchor the perforating device in the wellbore; and a multi-cycle incrementing tool to selectively move the perforating device over predetermined increments, wherein the multi-cycle incrementing tool comprises a stroke selected to correspond with the size of a perforation cavity formed, and a circulation port that opens at the end of the stroke to provide a pressure indication that the multi-cycle incrementing tool has fully extended.

2. The system as recited in claim 1, wherein actuating the perforating device at each predetermined increment enables creation of a continuous cut in a surrounding formation.

3. The system as recited in claim 1, wherein the perforating device comprises a plurality of perforating jet nozzles.

4. The system as recited in claim 1, wherein the perforating device comprises a plurality of shaped charges.

5. The system as recited in claim 1, wherein the multi-cycle incrementing tool comprises a spring that applies an internal bias and a compensating bias region fed by internal pressure to facilitate movement of spring.

6. A system for making cavities in a wellbore, comprising:

a perforating string sized for deployment in a wellbore, the perforating string comprising:

a perforating device;

an anchoring mechanism to anchor the perforating device in the wellbore, and a multi-cycle incrementing tool to selectively move the perforating device over predetermined increments, wherein the multi-cycle incrementing tool comprises a stroke selected to correspond with the size of a perforation cavity formed, and a circulation port that opens at the end of the stroke to provide a pressure indication that the multi-cycle incrementing tool has fully extended;

an orienting device to orient the multi-cycle incrementing tool in the wellbore, wherein the orienting device comprises a swivel and an eccentric mass; and a valve positioned in the perforating string to selectively allow fluid to be pressurized in the perforating string or to flow upwardly through the perforating string.

7. A method of making cavities in a wellbore, comprising:

coupling a perforating device and a multi-cycle incrementing tool into a perforating string;

moving the perforating device and the multi-cycle incrementing tool into a deviated wellbore; and controlling incremental movements of the perforating device with the multi-cycle incrementing tool, wherein the multi-cycle incrementing tool has a stroke selected to correspond with the size of a perforation cavity formed, and a circulation port that opens at the end of the stroke to provide a pressure indication that the multi-cycle incrementing tool has fully extended.

8. The method as recited in claim 7, further comprising creating cavities in the wellbore between the incremental movements.

9. The method as recited in claim 8, wherein controlling comprises selecting a travel distance for the incremental movements such that a plurality of sequentially created cavities are linked.

10. The method as recited in claim 8, wherein creating comprises at least one of creating cavities with a plurality of jetting nozzles or creating cavities with a plurality of shaped charges.

11. The method as recited in claim 7, further comprising anchoring the perforating string in the deviated wellbore during the incremental movements of the perforating device.

12. A method, comprising:

creating a perforation in a wellbore with a perforating device;

incrementally moving the perforating device with an incrementing tool; and forming a subsequent perforation linked with the perforation, wherein the incrementing tool has a stroke selected to correspond with the size of a perforation cavity formed, and a circulation port that opens at the end of the stroke to provide a pressure indication that the incrementing tool has fully extended.

13. The method as recited in claim 12, wherein forming comprises forming additional perforations that are linked to create a cut in the formation surrounding the wellbore.

14. The method as recited in claim 13, further comprising cycling the perforating device through a previously perforated area to create deeper perforations or to treat previously made perforations.

15. The method as recited in claim 12, wherein incrementally moving comprises using a continuous J-slot incrementing tool.

16. A system for controlling a perforation operation in a wellbore, comprising:

an apparatus to control the sequential formation of incrementally spaced cavities, the apparatus comprising:

a perforating mechanism and a continuous J-slot to control the incremental movement of the perforating mechanism; and a spring and a compensating bias region to actuate the apparatus from a J-slot position to a next sequential J-slot position, the actuation occurring upon selective reduction of a pressure below a net bias pressure exerted by the spring and the compensating bias region.

17. The system as recited in claim 16, further comprising coiled tubing to deliver the apparatus to a desired wellbore location.

* * * * *